United States Patent [19]

DesOrmeaux et al.

[11] Patent Number: 4,606,283

[45] Date of Patent: Aug. 19, 1986

[54] SYSTEM FOR EXTRACTING CONTAMINANTS AND HYDROCARBONS FROM CUTTINGS WASTE IN OIL WELL DRILLING

[76] Inventors: Farrell P. DesOrmeaux; Thomas F. DesOrmeaux; Mark R. DesOrmeaux, all of P.O. Box 30059, Lafayette, La. 70503

[21] Appl. No.: 711,590

[22] Filed: Mar. 13, 1985

[51] Int. Cl.[4] ..... F23G 5/00; F26B 10/02; F27B 9/06; F27B 5/14

[52] U.S. Cl. ..... 110/250; 34/141; 34/179; 110/224; 110/228; 219/388; 219/390; 432/139

[58] Field of Search ..... 432/72, 139, 151, 154; 34/139, 141, 179; 219/388, 390; 110/224, 227, 228, 335, 250, 255

[56] References Cited

U.S. PATENT DOCUMENTS

| | | | |
|---|---|---|---|
| 558,974 | 4/1896 | McClellan | 122/2 |
| 957,184 | 5/1910 | Bolander | 110/102 |
| 1,475,361 | 11/1923 | Stogdale | 198/575 |
| 1,735,396 | 11/1929 | Hiller | 34/179 |
| 1,773,202 | 8/1930 | Rosenfield | 110/228 |
| 2,211,733 | 8/1940 | Soderberg | 432/154 |
| 3,395,241 | 7/1968 | Roman | 219/390 |
| 3,541,293 | 11/1970 | MacDonald et al. | 219/390 |
| 4,089,277 | 5/1978 | Paul | 110/228 |
| 4,213,947 | 7/1980 | Fremont et al. | 432/72 |
| 4,257,334 | 3/1981 | Mueller | 110/104 R |
| 4,261,795 | 4/1981 | Reilly | 110/257 |
| 4,313,785 | 2/1982 | Schellstede | 159/6.2 |
| 4,338,869 | 7/1982 | Hoskinson | 110/346 |
| 4,342,269 | 8/1982 | Hoskinson | 110/257 |
| 4,351,250 | 9/1982 | Chartrand et al. | 110/227 |
| 4,430,057 | 2/1984 | Hoover et al. | 34/179 |
| 4,479,048 | 10/1984 | Kinoshita | 219/388 |

FOREIGN PATENT DOCUMENTS

| | | | |
|---|---|---|---|
| 405137 | 10/1924 | Fed. Rep. of Germany | 219/390 |

*Primary Examiner*—John J. Camby

*Attorney, Agent, or Firm*—Pravel, Gambrell, Hewitt & Kimball

[57] ABSTRACT

A system wherein the contaminated cuttings are fed into the system for eventual incineration. The principal apparatus of the system comprises a plurality, preferably three, of horizontally disposed cylindrical drying chambers mounted onto a skid for receiving contaminated cuttings into each separate chamber. There is provided on the first end of the chambers a receiving bin or hopper, wherein the cuttings are received from the shakers or the like into the bin, and dropped into an opening in the first end of the three chambers. Each chamber is provided with a separate variable motor controlled auger disposed substantially throughout the length of the chamber wherein rotation of the auger would move the cuttings along the length of the interior of the chamber. The second end of each chamber is provided with a lower exit chute for removal of the cuttings from the chamber as the auger has moved them into position. The cuttings would then be collected in a polyurethane bag or the like.

9 Claims, 4 Drawing Figures

SYSTEM FOR EXTRACTING CONTAMINANTS AND HYDROCARBONS FROM CUTTINGS WASTE IN OIL WELL DRILLING

BACKGROUND OF THE PRESENT INVENTION

1. Technical Field

The system of the present invention relates to oil well cuttings. More particularly, the system of the present invention relates to an apparatus and process for extracting contaminants and hydrocarbons from cuttings wastes in oil base and water base drilling fluid systems.

2. General Background

In the field of oil well drilling, during the process of drilling the well, drilling fluids are utilized for several purposes, one of which is to be pumped downhole for flushing away the cuttings as the drill bit cuts through the strata of earth. The cuttings are removed upward along the annular space between the drill string and the borehole, and are brought above ground.

In order to reuse relatively uncontaminated drilling fluid, the drilling fluid and cuttings that are brought up from the borehole are processed through a series of shale shakers and the like wherein the drilling fluid and cutting are sifted so that the drilling fluid is allowed to flow back for reuse in the borehole, and the cuttings then are removed, often times to a waste pit or the like. At present, there are pending regulations which will require that the onshore waste pits be disallowed, therefore, there is an ever impending need for a means for disposal of cuttings which are usually highly contaminated with hydrocarbons or other fluids.

There is known in the art several apparatuses, one of which pertains to a conveyor system for moving the cuttings through a chamber wherein the cuttings are "fired" by flames in order to dry them to an ashen state and thus removed as dry cuttings. The shortcoming in this particular apparatus is that an open flame near the site of a borehole is extremely dangerous and is now disallowed under present federal and state regulations. Therefore, there is a present need for an apparatus or system wherein the cuttings can be dried and safely incinerated to remove the hydrocarbons and other contaminants prior to the cuttings being hauled away and either stored or used for other purposes after decontamination.

An additional conventional method available is the cuttings washer system which is a very expensive system to utilize ranging from $300 to $600 per day plus the additional cost of an emulsifier or soap to supply the cuttings washer with dispersing capabilities. Because of recent restrictions, it becomes necessary to collect the cuttings in 25 to 50 gallon barrel tanks which must then be transported to dock site and further transported to a waste disposal site. The cost for disposal of this waste ranges from $8 to $20 a barrel thus the total costs of the washer system ranges to a $2,500 per day cost.

SUMMARY OF THE PRESENT INVENTION

The system of the present invention solves the problems and shortcomings in the art in a straightforward manner. What is provided is a system wherein the contaminated cuttings are fed into the system for eventual incineration. The principal apparatus of the system comprises a plurality, preferably three, of horizontally disposed cylindrical drying chambers mounted onto a skid for receiving contaminated cuttings into each separate chamber. There is provided on the first end of the chambers a receiving bin or hopper, wherein the cuttings are received from the shakers or the like into the bin, and dropped into an opening in the first end of the three chambers. Each chamber is provided with a separate variable motor controlled auger disposed substantially throughout the length of the chamber wherein rotation of the auger would move the cuttings along the length of the interior of the chamber. The second end of each chamber is provided with a lower exit chute for removal of the cuttings from the chamber as the auger has moved them into position. The cuttings would then be collected in a polyurethane bag or the like.

Each chamber is further provided with an interior wall and an exterior wall an annular area therebetween which houses a heating source for intense heating of the interior of the chamber during the process. For the drying and incineration of the cuttings as the cuttings are driven through the length of the chambers by the auger, this heating source in the wall of the chambers further provides a plurality of electrically heated rods inserted in the annular space and adjacent to the interior wall of the chamber, extending substantially throughout the length of each chamber. The series of 18 rods are so situated as to supply an even distribution of heat into the interior of the chamber during the movement of the wastes therethrough so that the heating rods, which preferably provide each chamber with 800° to 850° F. of optimum heat for incineration of the hydrocarbons, also has the capability to heat each chamber up to a maximum of 1600° F. In order to further enhance conductivity of the interior wall of the chamber for providing an evenly distributed layer of heat throughout, there is provided a continuous coating of graphite paint or cement which coats each heating rod and further provides a continuous surface from the heating rod onto the outer interior wall of the chamber for conducting heat along that entire interior wall. In the annular space between the heating rods and the exterior wall there is provided a quantity of insulation material insuring that the heat provided by the rods is directed towards the interior of the chamber and not out toward atmosphere.

There is further provided an upper exhaust opening on each chamber, which could be fitted with a catalytic converter of activated charcoal or the like for allowing venting to atmosphere of poisonous gases from the wastes that are being incinerated within the chamber during the drying process. A fan is situated atop each exhaust in order to force air thorugh the chambers during the drying process, to remove gases therewithin. Further, there is provided a plurality of hinged door members on the upper surface of each chamber for easy access into the chamber should an auger becomed blocked by larger cuttings or the like.

Therefore, it is an object of the present invention to provide a system for decontaminating oil well cuttings through incineration within a closed chamber;

It is a further object of the present invention to provide a system for allowing complete drying and incineration of oil well cuttings for easy removal from the well site;

It is still a further object of the present invention to provide a system for receiving cuttings into drying chambers and crushing the cuttings by means of blades of an auger system thus reducing the size of the cuttings and increasing the surface area or density which then allows the dry heat to extract the hydrocarbons therefrom.

In order to accomplish the above objects of the present invention, it is a feature of the present invention to provide a system having a plurality of chambers wherein cuttings are fed therethrough for drying;

It is a further feature of the present invention to provide a drying and incineration system for oil well cuttings wherein the cuttings are removed by an auger as they are moved through the chambers;

It is still a further feature of the present invention to provide a system for drying decontaminated oil well cuttings which is explosion proof and closed off from the atmosphere during the drying process.

BRIEF DESCRIPTION OF THE DRAWINGS

For a further understanding of the nature and objects of the present invention, reference should be had to the following detailed description, taken in conjunction with the accompanying drawings in which the parts are given like reference numerals and wherein.

DETAILED DESCRIPTION OF THE PREFERRED EMBODIMENT

Figure 1:
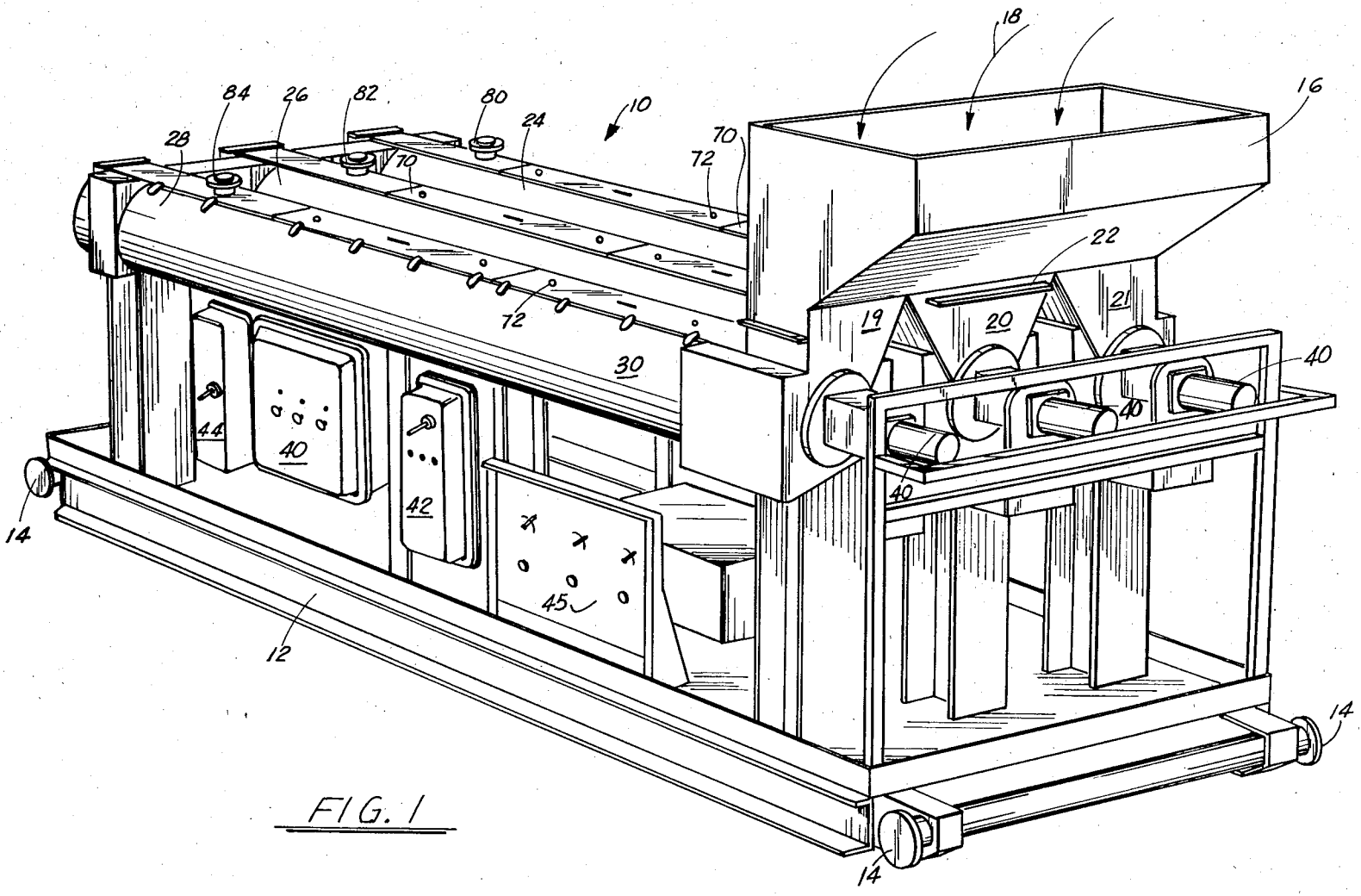
FIG. 1 is an overall perspective view of the principal apparatus of the system of the present invention.
Figures 2, 3:
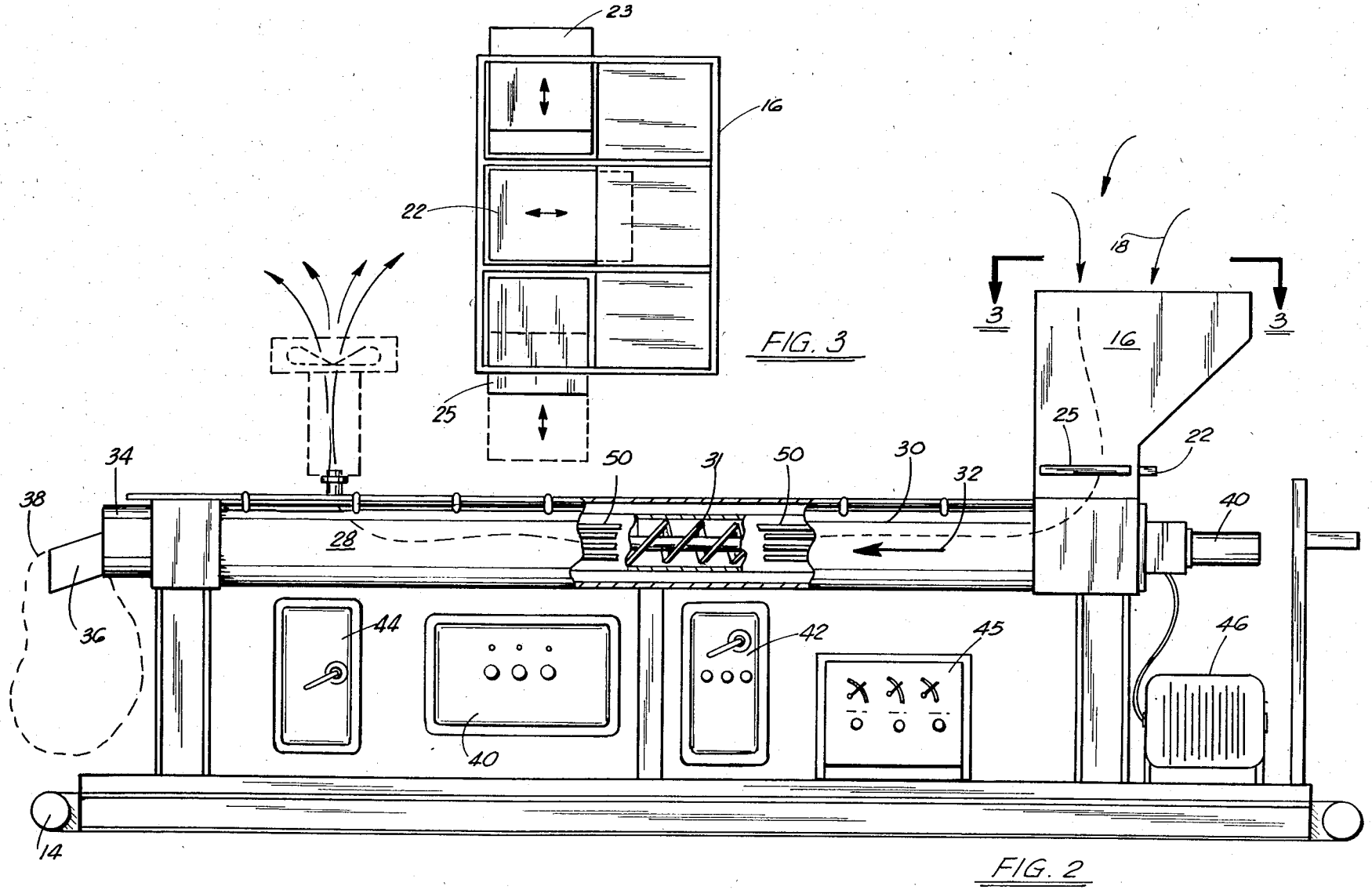
FIG. 2 is a partial cutaway side view of a drying chamber of the system of the present invention.
FIG. 3 is a top view of the receiving bin portion of the apparatus of the present invention.
Figure 4:
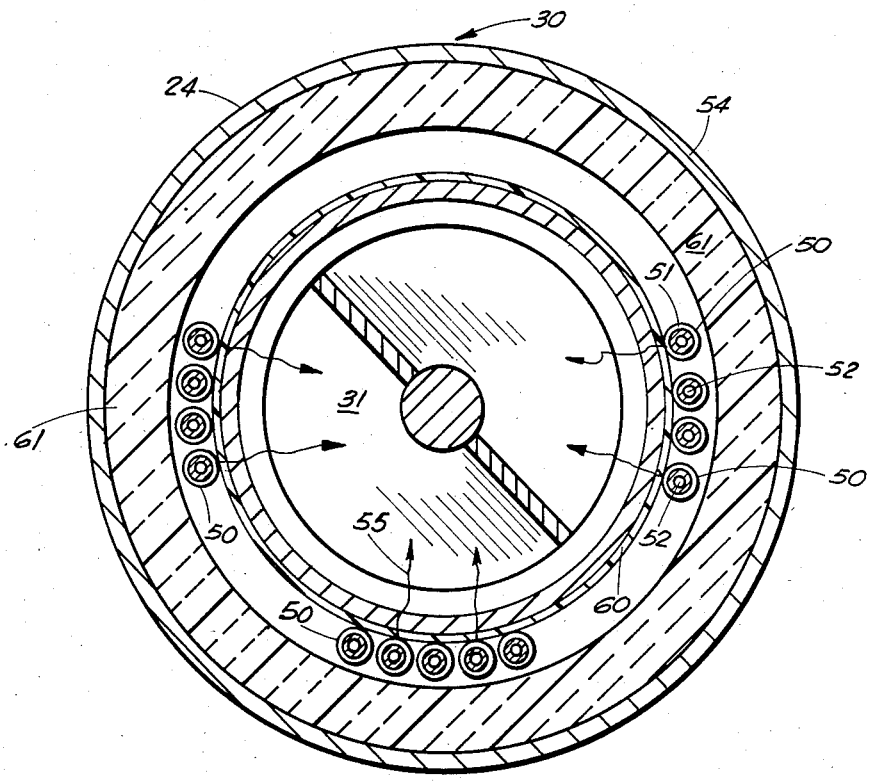
FIG. 4 is a cross-section view through a drying chamber of the apparatus of the present invention illustrating the coating material around the interior wall of the chamber in the system of the present invention.

FIGS. 1–4 illustrate the system of the present invention by the numeral 10. Apparatus 10 would generally comprise a rigid base skid portion 12 which would be constructed of angle iron or the like for providing a secure foundation for apparatus 10. Each of the corners of the base portion further provide a lift arm 14 for providing means for lifting the entire apparatus onto and off to a rig site or the like. Mounted upon skid 12 there is first provided collection bin or hopper 16 which would generally comprise a top open ended collection bin for allowing waste cuttings from the shale shakers (not shown) to fall thereinto as illustrated by ARROWS 18 with the cuttings moving into chutes 19,20 and 21 of bin 16. So as to regulate the flow of cuttings down the three respective chutes, there is further provided slidable plate means, (for example, 22,23 and 25 as seen in FIG. 3,) which are slidably movable to adjust the flow opening through chutes 19,20 and 21 as the cuttings move down into the main drying chambers.

As seen in the FIGURES, each chute 19,20 and 21 allows cuttings to fall into each separate means 30 for drying and incinerating cuttings during the process. This drying means 30 would generally comprise three separate horizontally disposed drying chambers respectively 24,26 and 28. As seen in the FIGURES, each chute 19,20 and 21 would empty into an upper opening of each horizontally disposed drying chamber for collection of the cuttings thereinto. As is seen in FIG. 3, there is further provided auger 31 which is disposed substantially throughout the length of each horizontal drying chamber 24,26 and 28 so that rotation of the auger would break the larger cuttings up into smaller cuttings to provide a greater surface area for drying out and would also move the cuttings through the chamber in the direction of ARROW 32. At the second end portion 34 of each drying chamber 24,26 and 28 there is provided an exit chute 36 allowing the cuttings to fall out of each drying chamber into a polyurethane bag 38 or the like as seen in phantom view.

Rotation of each auger 30 in each of the separate drying chambers is provided by a variable speed hydraulic motor 40 which is directly linked to each separate auger 30 so that rotation of the shaft of motor 40 would impart likewise rotation to auger 30 within each of the drying chambers. Therefore, if one wished to operate a single chamber or a pair of chambers, one could close off a respective bin and open other respective bins and operate the chambers accordingly. As seen also mounted on skid 12, there is further provided main power units 40,42 and 44 and control panel 45 which serve to regulate and control the electrical supply boxes for operation of the variable hydraulic motor 40 and other electrically operated features of the system which will be discussed further. Also, there is provided main electric motor 46 which provides the power to operate hydraulic motors 40.

As the cuttings are moved and crushed to smaller components through each horizontally disposed chamber 24,26 and 28 respectively, via the rotation of auger 30 within each of said chambers, there is provided means for drying and incinerating the cuttings as they are moved from the point of entry at the first end of each chamber to the point of exit through chute 36 of each of the chambers. As seen particularly in FIGS. 2 and 4, this means for drying and incinerating the contaminated cuttings, would comprise a plurality of heating elements 50, and as seen in FIG. 3, each of said heating elements 50 comprising a metallic heating rod 52 disposed horizontally between inner wall 53 and outer wall 54 of each of said chambers. As seen in the cross sectional view of FIG. 4, there would preferably be provided a series of four heating elements 50 along one side wall of each chamber, a series of four heating elements 50 along a second side wall of the chamber and a series of five heating elements 50 along the bottom portion of the chamber wall. As further seen in the FIGURES, each of the heating elements 50 would be adjacent the inner wall 53 of each chamber so that heat would be more properly directed inwardly toward the interior of chamber 58 as seen by ARROWS 55, with a layer of insulation material 61 between the heating elements 50 and the exterior wall 54 of each of the chambers to assure directing heat inwardly toward the interior of each chamber 58.

Most crucial to the heating ability of the heating elements in obtaining the requisite heat, i.e., optimumly between 800° F. and 850° F. to a maximum of 1600° F. within each of the chambers during the drying and incinerating process, there is further provided means for evenly distributing the heat around the circumferential inner wall 53 of each of the chambers. This means for distributing the heat would comprise a layer of paint 60 which would contain approximately 12% or more graphite material for serving as a heat conductor, thus conducting even heat throughout the internal heating chamber and not the radiation of the heat, to insure that the heat provided by rods 50 is evenly distributed through a "blanket" coating through the inner chamber wall. In the preferred embodiment, each rod 50 would be inserted into tube or element casing 51, which would be thoroughly coated with a cement or paint layer 60 and serve as a continuous coating for the entire outer interior wall of each chamber. This cement or paint layer 60 would conduct heat from each heating element to be evenly distributed around the wall of the chamber and would allow substantially equal heating throughout the circumference of the interior wall, therefore providing more thorough drying of the cuttings within the interior of each chamber as the cuttings move therethrough. Further, inside of each heating element casing 51, there is further provided a magnesium oxide powder which is utilized to conduct the heat directly from the element through the heating element casing 51, and through the heat graphite compound directly to the inner chamber wall thus making the heating of the system more efficient.

As seen in the FIGURES, each of chambers 24,26 and 28 would be further provided on the upper portion with a series of a hinged metal door covers 70 wherein in the opened position would provide access to augers 30 so that auger 30 could be cleared or cleaned while the process is not ongoing. Further, when the chamber doors 70 are in the closed position, each would be secured by bolts 72 so that any explosions or intense heat occurring through the chamber during the incinerating process would be closed to the atmosphere and would be internal within the chamber, thus preventing any possiblity of explosion or the like during the process.

As seen in the FIGURES, there is further provided an exhaust outlet 80,82 and 84 in each of the chambers respectively, for allowing the exhausting of gases during the incinerating process. Each exhaust could be further provided with a catalytic converter 65 or the like filter with volcanic rock and activated charcoal or the like for neutralizing any gases that are vented to the atmosphere during the incinerating process. In addition, if necessary, a scrubber or the like could be provided as a further means for cleaning the off gases. Situated atop each catalytic converter 65, there would be provided a suction fan 67, for drilling gases from within each chamber 24,26 or 28, during the decontamination, through filter elements or catalytic converter 65, and cleaning of the off gases, prior to venting to atmosphere.

The apparatus 10 as seen in the process could process approximately 25,000 to 40,000 pounds of cutting or mud waste per hour or between 25 to 40 barrels of cutting waste per hour. In the event the cuttings would be part of a thickened "gumbo" from downhole, an emulsifier or the like could be added to the cuttings for more easily distribution by the auger and drying and incinerating. Overall, the system utilizing the novelty of an internal electrical heating source would provid an economical and safe means for the ever increasing problem of drying and decontaminating cuttings from the well site.

Overall, the system would normally require approximately four minutes for the routing of the cuttings through each drying chamber. If necessary, in view of the fact that the auger motors are variable in speed, the process could be reduced in time, therefore, allowing more internal heating time to ensure complete drying. In the preferred embodiment, each drying chamber would be approximately 13 feet in length, with the entire unit occupying approximately 20 feet in length. Also, in the preferred embodiment, the interior diameter of each heating chamber would be approximately 10 inches, with a 9½ inch auger, therefore providing approximately ¼ inch space between the interior wall and the edge of the auger blade for the movement of cuttings through the drying chamber. As was stated earlier, the entire apparatus is controlled via the electrical system, wherein each drying chamber is provided with a separate control gauge and with a separate temperature gauge wherein there is provided a first dial for selecting the desired temperature, and a thermostat whereby when that desired temperature is reached, the heating elements are shut off until there is a need to bring the temperature back up to the desired temperature or wherein the heating elements are electronically reheated automatically. Also, in the preferred embodiment, should there be a defect or breakage in one of the heating elements, the heating rods may be pulled from the housing that they are placed in in the chamber, and replaced with a workable heating element within the apparatus.

Because many varying and different embodiments may be made within the scope of the inventive concept herein taught, and because many modifications may be made in the embodiment of the law, it is to be understood that the details herein are to be interpreted as illustrative and not in a limitng sense.

What is claimed as invention is:

1. An apparatus for drying, decontaminating and incinerating oil well cuttings containing water and hydrocarbons, the apparatus comprising:

a. a base portion;

b. at least one horizontally disposed cylindrical chamber mounted on the base portion, the chamber having a continuous wall defining a continuous bore therethrough and a first end for receiving the wet oil well cuttings thereinto;

c. auger means disposed coaxially withand along the length of the chamber bore for moving the cuttings from the first end to the second end of the chamber;

d. heating means, positioned radially around the wall of the chamber along its entire length, for providing heat within the chamber to a temperature of at least 750 degrees F. for incinerating the wet oil field cuttings moving through the chamber, the heating means including a plurality of electrical heating rods disposed within the internal wall of the drying chamber and positioned radially around the chamber wall;

e. heat conducting means comprising a continuous layer over the chamber wall forming a composite layer with the wall of the drying chamber that is positioned between the heating rods and the wall of the drying chamber for providing uniform conduction of heat from the rods into the chamber along substantially the entire length of the chamber.

2. The apparatus in claim 1, further providing means communicating with each of the drying chambers for allowing exhausting of gas during the drying, decontaminating and incinerating process.

3. The apparatus in claim 1, further comprising a means for drawing air through the drying chamber during the drying process.

4. The apparatus in claim 1, wherein each of the auger means is provided with a variable motor for varying the speed of the cuttings as the cuttings are moved through each of the drying chambers.

5. The apparatus of claim 1 wherein the heat conducting means includes a graphite layer.

6. The apparatus of claim 5 wherein the graphite layer includes a graphite cement.

7. The apparatus of claim 5 wherein the graphite layer is a graphite paint.

8. The apparatus of claim 1 further comprising means for varying the speed of movement of cuttings through the chamber bore.

9. The apparatus of claim 1 wherein there are a plurality of horizontally disposed drying chambers mounted upon a common support base, each chamber having a bore occupied by an auger.

* * * * *